US007091808B2

(12) United States Patent
Okubo

(10) Patent No.: US 7,091,808 B2
(45) Date of Patent: Aug. 15, 2006

(54) SOLENOID

(75) Inventor: Masashi Okubo, Nagano (JP)

(73) Assignee: Shinano Kenshi Kabushiki Kaisha, Nagano (JP)

( * ) Notice: Subject to any disclaimer, the term of this patent is extended or adjusted under 35 U.S.C. 154(b) by 0 days.

(21) Appl. No.: 10/533,199

(22) PCT Filed: Oct. 20, 2003

(86) PCT No.: PCT/JP03/13393

§ 371 (c)(1),
(2), (4) Date: Apr. 28, 2005

(87) PCT Pub. No.: WO2004/040595

PCT Pub. Date: May 13, 2004

(65) Prior Publication Data

US 2006/0001513 A1 Jan. 5, 2006

(30) Foreign Application Priority Data

Oct. 31, 2002 (JP) ..... 2002-317356

(51) Int. Cl.
*H01F 3/00* (2006.01)
*H01F 7/08* (2006.01)

(52) U.S. Cl. ..... 335/255; 335/258; 335/261; 335/279; 335/281

(58) Field of Classification Search ..... 335/255, 335/258, 261–263, 270, 273, 279, 281
See application file for complete search history.

(56) References Cited

FOREIGN PATENT DOCUMENTS

| | | | |
|---|---|---|---|
| JP | 49-91745 | U | 11/1972 |
| JP | 5-211744 | A | 8/1993 |
| JP | 7-336943 | A | 12/1995 |
| JP | 8-223895 | A | 8/1996 |
| JP | 9-153409 | A | 6/1997 |

*Primary Examiner*—Ramon M. Barrera
(74) *Attorney, Agent, or Firm*—Birch, Stewart, Kolasch & Birch, LLP

(57) ABSTRACT

A solenoid that has a small body and increased propulsion in a controlled range is provided.

The solenoid is characterized by being provided with a bearing 40 formed of a nonmagnetic body, n (where n is a positive integer of zero or above) grooves 56 and n+1 tooth parts 58 that are adjacent to the grooves 56 and function as magnetic poles being provided in a facing surface 52 of a first upper yoke 54*a*, m (where m is a positive integer of zero or above) grooves 70 and m+1 tooth parts 72, 74 that are adjacent to the grooves 70 and function as magnetic poles being provided in a facing surface 55 of a second upper yoke 54*b*, n+1 grooves 56 and n+1 tooth parts 58, 59 that are adjacent to the grooves 56 and function as magnetic poles being provided in a surface 52 of the slider 36 that faces the first upper yoke 54*a*, and m grooves 76 and m tooth parts 78 that are adjacent to the grooves 76 and function as magnetic poles being provided in a surface 55 of the slider 36 that faces the second upper yoke 54*b*.

16 Claims, 5 Drawing Sheets

SOLENOID

TECHNICAL FIELD

The present invention relates to a solenoid used as an actuator.

BACKGROUND ART

FIGS. 5 and 6 show constructions of typical solenoids that are conventionally known.

A solenoid 10 includes an excitation coil 12, a yoke 14 that is assembled so as to surround the excitation coil 12, a bearing 15 disposed in a central part of the excitation coil 12, and a slider 16 (a moving iron core or plunger) that is guided in a sliding state by the bearing 15 (see FIGS. 1 and 2, etc., of Japanese Laid-Open Patent Publication No. H05-211744).

The yoke 14 is constructed of at least two members, an upper yoke 14*a* and a lower yoke 14*b*, with the upper yoke 14*a* being disposed at one end and the lower yoke 14*b* being provided so as to close the other end of an enclosure 19 for the slider 16 so as to limit the movement in a direction A of the slider 16.

A surface 14*c* of the lower yoke 14*b* facing the other end-end surface 16*a* of the slider 16 functions as a fixed iron core.

When current flows through the excitation coil 12 of the solenoid 10 shown in FIG. 5, a magnetic path a is formed as shown by the dashed line, for example. It should be noted that the direction of the magnetic path a shown here is merely an example.

The magnetic path a passes inside the yoke 14, enters into the slider 16 from the upper yoke 14*a*, moves through the slider 16 along the axial direction toward the lower yoke 14*b* side, and passes to the fixed iron core part 14*c* of the lower yoke 14*b* from the other end-end surface 16*a* of the slider 16 via the air. Then the magnetic path a passes from the lower yoke 14*b* to the upper yoke 14*a* so as to form a closed loop.

The slider 16 is pulled onto the fixed iron core part 14*c* by the magnetic force produced in the gap B between the other end-end surface 16*a* of the slider 16 and the fixed iron core part 14*c* of the lower yoke. This magnetic force is the propulsion of the solenoid.

The propulsion of the solenoid 10 decreases exponentially in accordance with the distance of the gap B (that is, the stroke).

The construction of another conventional solenoid is shown in FIG. 6. Here, components that are the same as in the construction of the solenoid shown in FIG. 5 have been assigned the same reference numerals and description thereof has been omitted.

In this solenoid 20 also, the lower yoke 14*b* is provided so as to cover the other end-side end of the enclosure 19 for the slider 16. The fixed iron core part 14*c* of the lower yoke 14*b* is provided so as to protrude into the enclosure 19 for the slider 16, and a front end of the fixed iron core part 14*c* is formed as a concave 17 that is hollow in accordance with the shape of the other end-end surface 16*a* of the slider 16.

The other end-end surface 16*a* of the slider 16 is formed with a sharpened front end where the radius gradually decreases toward the other end-side so as to be capable of being enclosed in the concave 17 formed in the front end of the fixed iron core part 14*c* (see FIG. 1 of Japanese Laid-Open Patent Publication No. H07-336943).

The magnetic path in this solenoid 20 forms the same route as the magnetic path of the solenoid 10 shown in FIG. 5, and therefore is not illustrated, with the propulsion of the solenoid 20 being generated by a gap between the fixed iron core part 14*c* and the other end-end surface 16*a* of the slider 16. It is also known that the propulsion-displacement characteristics change in accordance with the taper angle of the other end-end surface 16*a* of the slider 16 in the solenoid 20.

As described above, the propulsion of the solenoid is determined by the magnitude of the magnetic energy stored in the gap between the fixed iron core and the slider. That is, magnitude of the propulsion is determined by the distance between the fixed iron core and the slider.

Here, the relationship between the stroke (amount of displacement) of the slider and the generated propulsion in a conventional solenoid is shown in FIG. 7. As shown in FIG. 7, in a conventional solenoid, the propulsion is smallest at a position where the slider is furthest away from the fixed iron core part and the propulsion increases as the slider approaches the fixed iron core part.

However, when the movable range of the slider and the controlled range (the operation range) have the relationship shown in FIG. 7, it is not possible to use large propulsion within the controlled range through which control of the solenoid is actually desired. The propulsion characteristics are also nonlinear, which means the controllability is poor.

In this kind of conventional solenoid, propulsion is generated between end surfaces of the slider at the end of the movable range and the fixed iron core part, and there has been the problem that as the movable range becomes wider, it has not been possible to set the controlled range at the optimal range in the propulsion characteristics of the solenoid.

There has also been the problem that in cases where the movable range is wide and the required propulsion in the controlled range is large, the size of the solenoid itself has to be increased to produce the propulsion.

For this reason, to solve the above problems, it is an object of the present invention to provide a solenoid that is small and where the propulsion within the controlled range can be increased.

DISCLOSURE OF THE INVENTION

That is, a solenoid according to the present invention includes: an excitation coil; a slider disposed in a center part of the excitation coil; and a yoke including a first yoke part that covers one end surface of the excitation coil and has a facing surface that faces an outer circumferential surface of the slider, a second yoke part that covers another end surface of the excitation coil and has a facing surface that faces the outer circumferential surface of the slider, and a linking part that links the first yoke and the second yoke and covers an outer circumferential part of the coil, the yoke forming a closed magnetic path together with the slider, wherein a non-magnetic bearing is sandwiched between the facing surface of the first yoke part and the facing surface of the second yoke part, is disposed on an outer circumference of the slider, and guides the slider in a movable state, n (where n is a positive integer of 0 or higher) grooves, which are provided so as to be concave around an inner circumference, and n+1 tooth parts, which are adjacent to the grooves and function as magnetic poles, are provided in the facing surface of the first yoke part, m (where m is a positive integer of 0 or higher) grooves, which are provided so as to be concave around an inner circumference, and m+1 tooth parts, which are adjacent to the grooves and function as magnetic poles, are provided in the facing surface of the second yoke part, n+1 grooves, which are provided so as to be concave around an outer circumference, and n+1 tooth parts, which are adjacent to the grooves and function as magnetic poles, are provided in a surface of the slider that faces the first yoke part, and m grooves that are provided so as to be concave around an outer circumference and m tooth parts that are adjacent to the grooves and function as magnetic poles are provided in a surface of the slider that faces the second yoke part.

The effects of the above construction are as follows.

That is, a magnetic path is formed inside the slider via the first yoke part and the second yoke part that face an outer circumferential surface of the slider and since unlike the conventional art, the propulsion generated between end surfaces of the slider and of a fixed iron core part is not required, the body size of the solenoid can be made smaller than before.

In addition, a portion of a fixed iron core part facing the end surface of the slider is not required to generate propulsion, therefore the movement of the slider is not limited with respect to the direction of movement. This means that regardless of the distance of the actual movable range of the slider, the solenoid can be designed so that an optimal range in the propulsion characteristics is used as the controlled range.

In addition, since propulsion is generated at two portions that are the first yoke part and the second yoke part, even when the stroke gradually approaches zero, the region where the propulsion is stable can be widened and the control characteristics can be improved without the propulsion increasing exponentially as in the conventional art.

Here, even if a facing surface were provided on the yoke as a magnetic pole, the magnetic path between the yolk and the slider formed in a direction perpendicular to the outer circumferential surface of the slider would contribute almost nothing to the propulsion without grooves on the surface of the slider (that is, if there were no tooth parts formed as magnetic poles). It should be noted that since it is known that propulsion is proportional to dP/dx (where P is permeance (the reciprocal of magnetic reluctance) and x is the displacement of the slider), to obtain propulsion, it is necessary to provide a construction where the permeance changes in accordance with the movement of the slider. For this reason, the invention obtains propulsion by providing a groove or grooves in the slider so that the permeance changes in accordance with the movement of the slider.

In addition, by assembling the first yoke part and the second yoke part with the bearing as an alignment, the respective gaps between the slider and the facing surface of the first yoke part and the facing surface of the second yoke part can be made extremely small with high precision. This means that the efficiency of the conversion from the electrical energy supplied to the excitation coil to magnetic energy is increased, and higher propulsion can be obtained.

By forming the facing surfaces on the first yoke part and the second yoke part with the same internal diameter, as described above, the efficiency of the conversion from the electrical energy supplied to the excitation coil to magnetic energy is increased, so that higher propulsion can be obtained.

The grooves and the tooth parts may be formed so as to be rectangular or trapezoidal in cross-section.

It should be noted that a part, which is an upper end edge part of the groove provided in the slider and is located on a far side with respect to the bearing in an axial direction, may be formed at a position that does not contact the bearing in a range where the slider moves.

With this construction, the upper end edge part of the groove is prevented from contacting and thereby damaging the bearing. This means that the working life of the solenoid can be extended.

In addition, if a recess is formed at the entrance of the bearing so that a part, which is an upper end edge part of the groove provided in the slider and is located on a far side with respect to the bearing in an axial direction, does not contact the bearing in a range where the slider moves, the upper end edge part of the groove can be prevented from contacting and thereby damaging the bearing. This means that the working life of the solenoid can be extended.

BEST MODE FOR CARRYING OUT THE INVENTION

Figure 1:
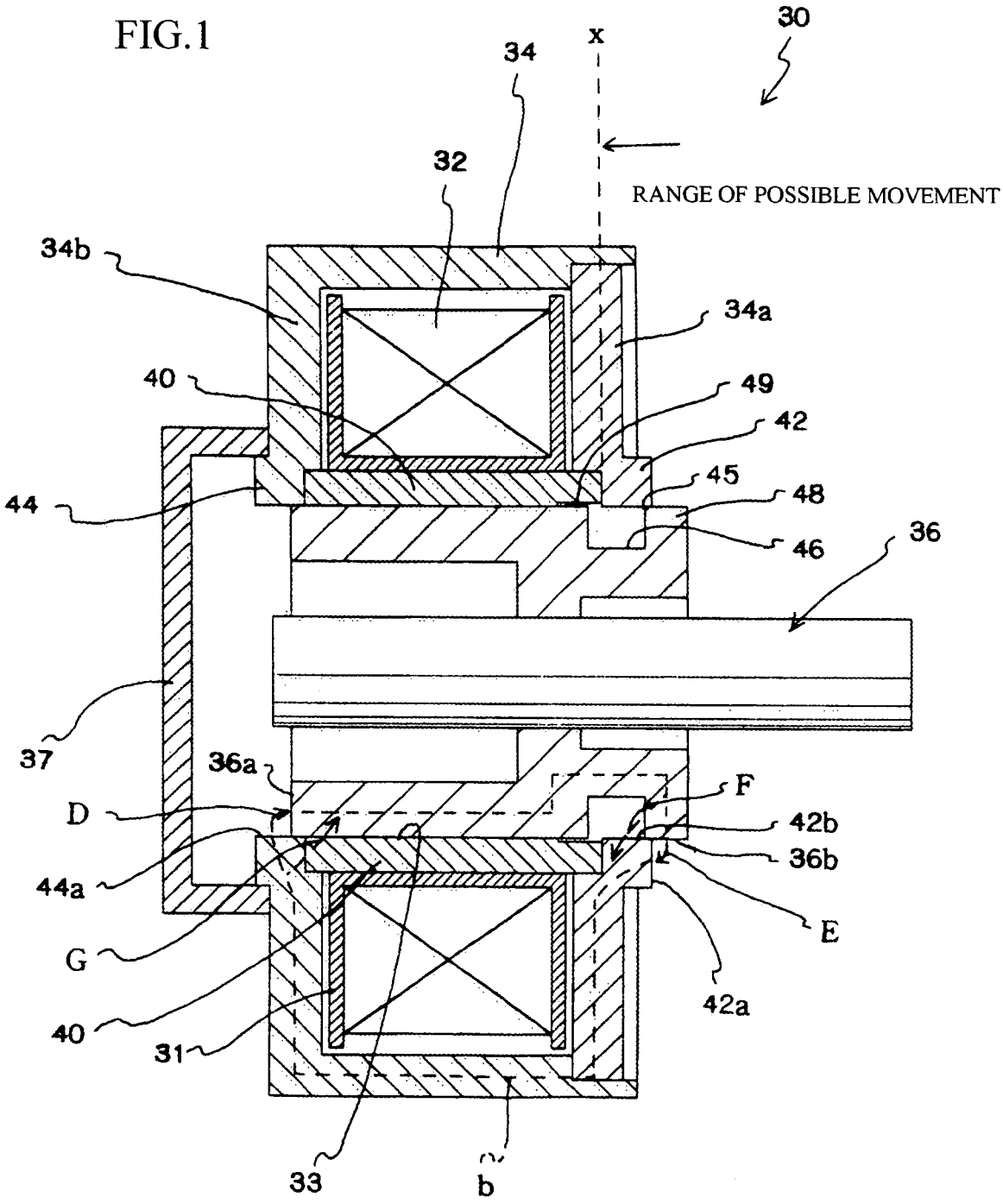
FIG. 1 is a cross-sectional view showing a first embodiment of a solenoid according to the present invention when viewed from a side surface.

Preferred embodiments of the present invention will now be described with reference to the attached drawings.

First Embodiment

In the present embodiment, the parameters n, m given in the patent claims are set so that n=0 and m=0. The present embodiment will be described with reference to FIG. 1.

A solenoid 30 includes an excitation coil 32, a yoke 34, and a slider 36.

The excitation coil 32 is formed in a tube shape by winding a coil around a bobbin 31. An enclosure 33 in which a slider 36 can be enclosed is formed at the center of the tube-shaped excitation coil 32.

The yoke 34 is made of a magnetic material, and is formed so as to cover a periphery of the excitation coil 32. The yoke 34 is composed of an upper yoke 34*a* disposed at one end of the excitation coil 32 and a lower yoke 34*b* disposed at the other end.

It should be noted that the "first yoke part" referred to in the patent claims corresponds to the upper yoke 34*a* and the "second yoke part" to the lower yoke 34*b*. It should be noted that the "linking part" referred to in the patent claims also corresponds to the lower yoke 34*b* of the present embodiment and is constructed so as to be integrated with the second yoke part.

The slider 36 is a member composed of a magnetic body and is disposed inside the enclosure 33 in the central part of the excitation coil 32. The slider 36 operates in the direction of an attractive force due to magnetic energy produced by the excitation coil 32.

It should be noted that movement in the protruding direction of the slider 36 is caused by a spring or the like (not shown).

A bearing 40 is disposed on an inner wall of the enclosure 33 formed in the central part of the excitation coil 32 so as to surround an outer circumferential surface of the slider 36. The bearing 40 is composed of a nonmagnetic body. The bearing 40 is sandwiched at both ends in the axial direction by the upper yoke 34*a* and the lower yoke 34*b*.

It should be noted that a cover 37 is provided on the lower yoke 34*b* so as to cover an open end on the other end-side of the enclosure 33.

An inner wall surface of the upper yoke 34*a* that protrudes into the enclosure 33 is a facing surface 42. The facing surface 42 is disposed facing the outer circumferential surface of the slider 36 and is disposed so as to become a magnetic pole for the outer circumferential surface 36*b* and the end surface 36*a* of the slider 36.

That is, in the present embodiment, the facing surface 42 is a "tooth part".

The facing surface 42 is disposed at a slight gap from the outer circumferential surface 36*b* of the slider 36 that is sufficient to prevent contact.

An inner wall surface of the lower yoke 34*b* that protrudes into the enclosure 33 is a facing surface 44. In the same way as the facing surface 42 described above, the facing surface 44 is also disposed facing the outer circumferential surface 36*b* of the slider 36, and is disposed so as to become a magnetic pole for the outer circumferential surface 36*b* and the end surface 36*a* of the slider 36.

That is, in the present embodiment, the facing surface 44 is also a "tooth part".

The facing surface 44 is disposed at a slight gap from the outer circumferential surface 36*b* of the slider 36 that is sufficient to prevent contact.

It should be noted that the width of the gap is the same as the width of the gap between the facing surface 42 and the outer circumferential surface 36*b* of the slider 36.

It is possible to manufacture the solenoid 30 so that the gaps are the same for the facing surfaces 42, 44 and have an extremely minute width since an accurate assembling of the components can be achieved during the manufacturing stage of the solenoid 30 by assembling the upper yoke 34*a* and the lower yoke 34*b* with the bearing 40 as an alignment.

In the present embodiment, a groove 46 is formed in the outer circumferential surface 36*b* of the slider 36 at a part corresponding to the facing surface 42 of the upper yoke 34*a*.

The groove 46 is formed so as to be concave in a direction away from the facing surface 42 and is formed in a ring around the outer circumference of the slider 36.

The one end-side of the groove 46 (the side distant from the bearing 40) is positioned facing the facing surface 42 of the upper yoke 34*a* as a tooth part 48, and functions as a magnetic pole.

The formation position of the groove 46 shown here is such that the groove 46 is formed at a position located a distance equal to the width of the facing surface 42 displaced from the other end of the slider 36 toward the one end. That is, the tooth part 48 is formed with substantially the same width as the width of the facing surface 42 facing the tooth part 48.

A recess 49 formed with a larger diameter than other parts is formed at the end of the bearing 40 on the upper yoke 34*a* side so that an upper end edge part 45 (that is, an end part of the tooth part 48) of the groove 46 on a side distant from the bearing 40 does not come into contact within the range of possible movement of the slider 36.

It should be noted that the range of possible movement of the slider 36 may be set so that the upper end edge part 45 (that is the end part of the tooth part 48) on the side of the groove 46 that is distant from the bearing 40 does not contact the bearing 40.

That is, as shown in FIG. 1, the range of possible movement of the slider 36 is designed so that the upper end edge 45 stops short of a position x i.e. the end of bearing 40 when the slider has been pulled as far as possible into the solenoid by attraction.

According to this construction, damage to the bearing 40 can be prevented, and in this case, the recess 49 does not need to be formed in the bearing 40.

Next, the magnetic path of the solenoid of the present embodiment will be described.

When a predetermined current flows through the excitation coil 32 of the solenoid 30, a magnetic path b is produced as shown by the dotted line. It should be noted that the direction of the magnetic field of the magnetic path b shows merely an example. The magnetic path that surrounds the excitation coil 32 shown on the upper side in FIG. 1 has been omitted from the drawing.

The magnetic path b is composed of a closed magnetic path that passes through the yoke 34 and the slider 36 in a circle.

That is, the magnetic path b passes through the lower yoke 34*b*, through the air from an inner circumferential surface 44*a* of the facing surface 44 of the lower yoke 34*b* into the slider 36 via the end surface 36*a* the slider 36 (arrow D), inside the slider 36 along the axial direction, and reaches the facing surface 42 of the upper yoke 34*a*. The magnetic path b passes from the outer circumferential surface 36*b* of the slider 36 through the air to an end surface 42*a* of the facing surface 42 (arrow E), and passes from the upper yoke 34*a* to the lower yoke 34*b*, thereby completing a circle.

The magnetic paths that are origin of the propulsion consist of the magnetic path from the tooth part 48 of the slider 36 via an inside of the groove 46 to an inner circumferential surface 42*b* of the facing surface 42 (the arrow F) and the magnetic path from the facing surface 44 via the bearing 40 to the outer circumferential surface 36*b* of the slider 36 (the arrow G).

In this way, by providing the groove 46 in the slider 36, a tooth part that acts as a magnetic pole is formed in the slider 36, which assists in the formation of magnetic paths that contribute to the propulsion.

In other words, since propulsion is determined by the change in the permeance with respect to the moved amount of the slider (based on the expression dP/dx mentioned above), by providing the groove 46 in the slider 36, when the slider 36 moves, the permeance can be changed in accordance with the movement and therefore propulsion can be generated.

Second Embodiment

Figure 2:
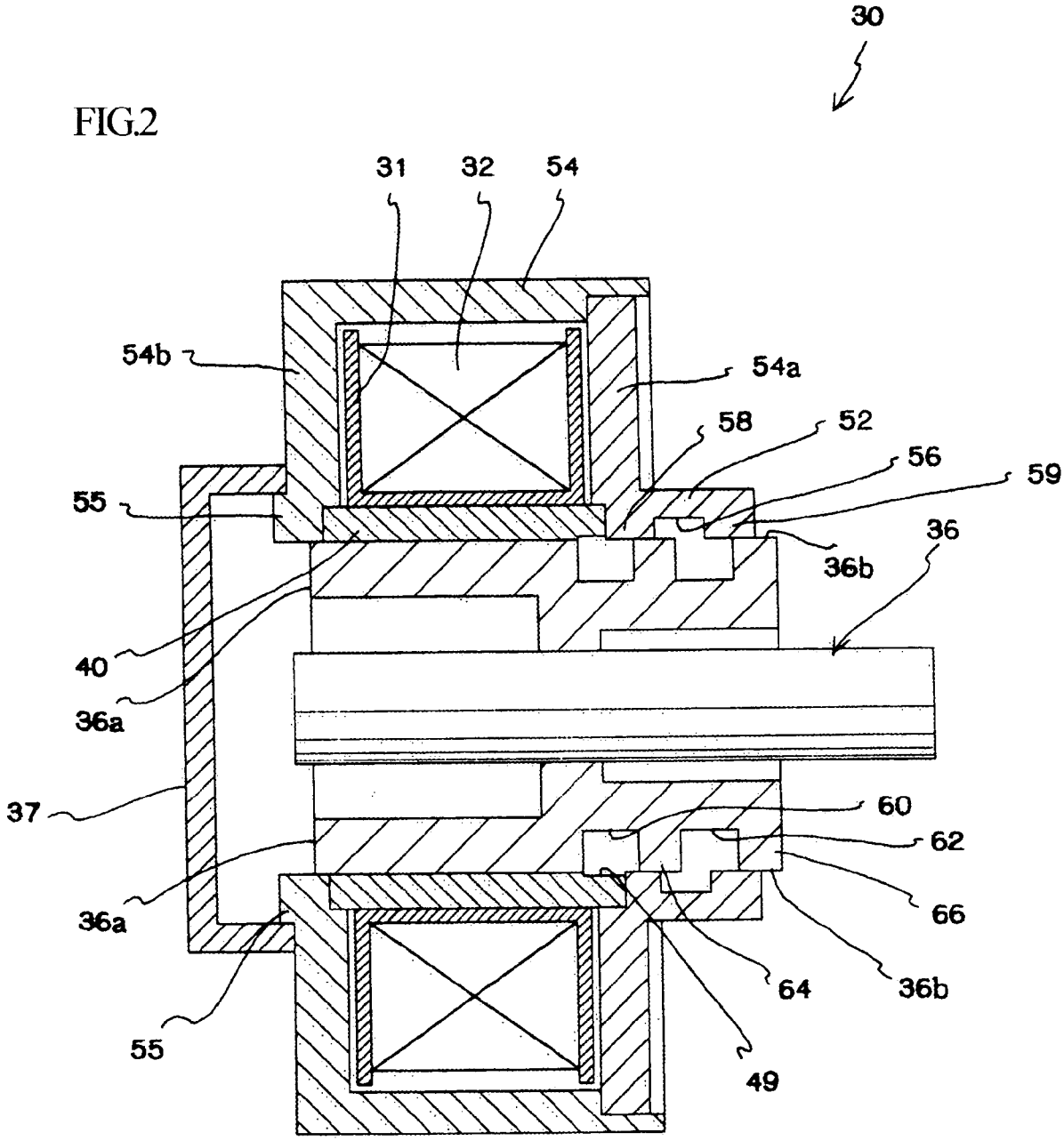
FIG. 2 is a cross-sectional view showing a second embodiment of a solenoid according to the present invention when viewed from a side surface.

Next, a second embodiment where the formation positions of the groove and the tooth parts differ to the first embodiment described above will be described with reference to FIG. 2. It should be noted that some components that are the same as in the embodiment described above have been designated the same reference numerals and description thereof has been omitted.

In the present embodiment, the parameters n, m given in the patent claims are set so that n=1 and m=0.

The yoke 54 includes an upper yoke 54*a* and a lower yoke 54*b*.

A groove 56 is formed in a facing surface 52 on an inner wall surface of the upper yoke 54*a* that protrudes into the enclosure 33.

The groove 56 is formed so as to be concave in a direction away from the outer circumferential surface 36*b* of the slider 36 and is formed in a circle around the inner circumference of the facing surface 52.

The respective ends of the groove 56 are formed as a tooth part 58 and a tooth part 59. Both tooth parts 58, 59 are positioned opposite a groove and a tooth part (described later) of the outer circumferential surface 36*b* of the slider 36 and function as magnetic poles.

The facing surface 52 of the upper yoke 54*a* is disposed at a slight gap from the outer circumferential surface 36*b* of the slider 36 that is sufficient to prevent contact.

An inner wall surface side of the lower yoke 54*b* that protrudes into the enclosure 33 is a facing surface 55. In the same way as the facing surface 52 described above, the facing surface 55 is also disposed facing the outer circumferential surface 36*b* of the slider 36, and is disposed so as to be a magnetic pole for the outer circumferential surface 36*b* and the end surface 36*a* of the slider 36. That is, the facing surface 55 is also a tooth part.

The facing surface 55 is disposed at a slight gap from the outer circumferential surface 36*b* of the slider 36 that is sufficient to prevent contact.

It should be noted that two grooves 60 and 62 are formed in a part of the outer circumferential surface 36*b* of the slider 36 that faces the facing surface 42 of the upper yoke 34*a*.

The grooves 60, 62 are formed so as to be concave in a direction away from the facing surface 52 and are formed in circles around the outer circumference of the slider 36.

The one-end side of the groove 62 (the side that is distant from the bearing 40) is positioned facing the facing surface 52 of the upper yoke 54*a* as a tooth part 66 and functions as a magnetic pole.

A part sandwiched by the groove 60 and the groove 62 is also formed as a tooth part 64 that functions as a magnetic pole.

That is, the present embodiment is characterized by the single groove 56 and the two tooth parts 58, 59 being provided in the upper yoke 54*a* and the two grooves 60, 62 and the two tooth parts 64, 66 being provided at positions of the slider 36 that face the upper yoke 54*a*.

By increasing the number of tooth parts that act as magnetic poles in this way compared to the first embodiment, a higher permeance is achieved than in the first embodiment, so that even higher propulsion can be realized.

Third Embodiment

Figure 3:
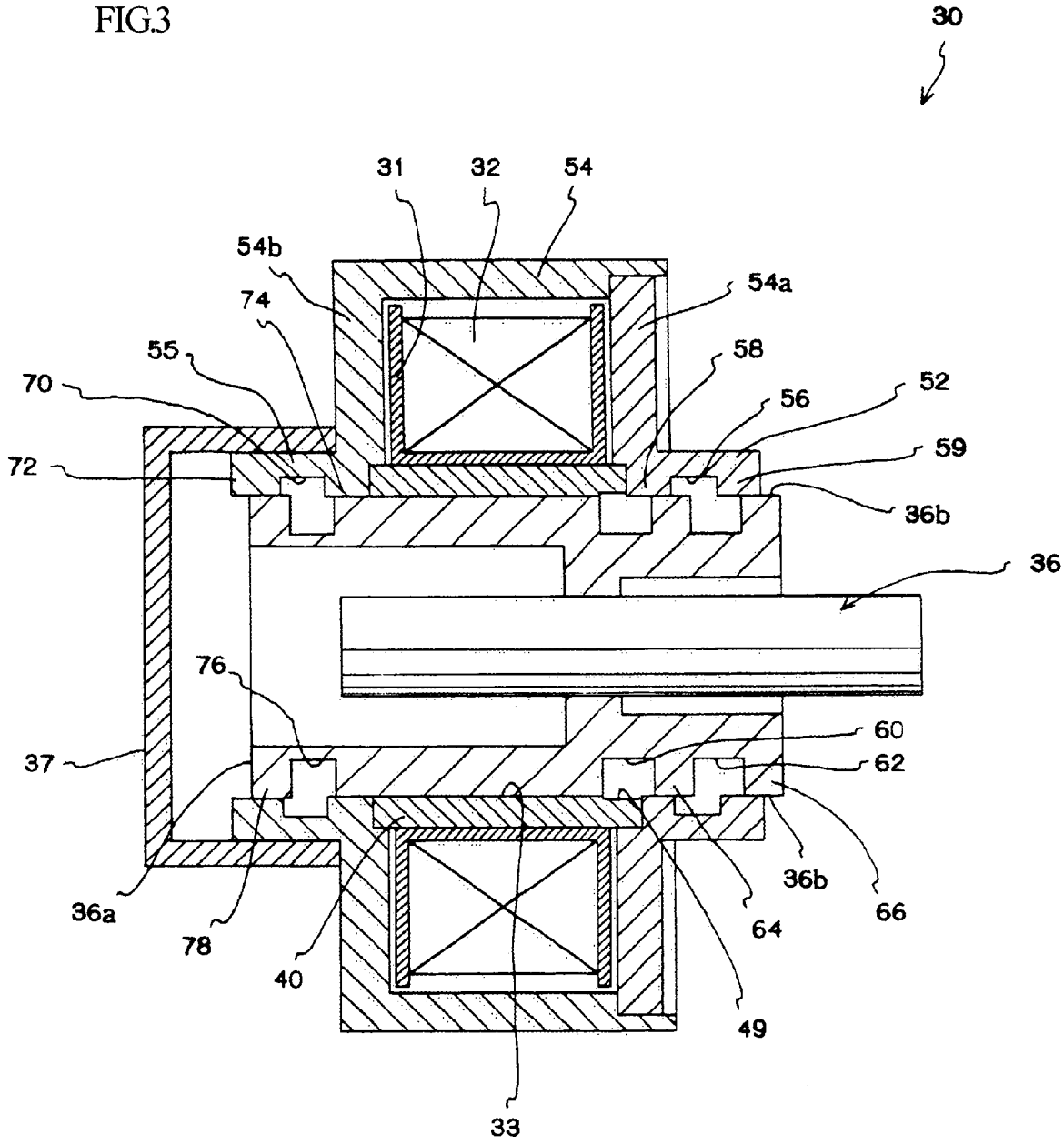
FIG. 3 is a cross-sectional view showing a third embodiment of a solenoid according to the present invention when viewed from a side surface.

Next, a third embodiment where the formation positions of the tooth parts differ to the first and second embodiments described above will be described with reference to FIG. 3. It should be noted that some components that are the same as in the embodiments described above have been designated the same reference numerals and description thereof has been omitted.

In the present embodiment, the parameters n, m given in the patent claims are set so that n=1 and m=1.

In the present embodiment, in addition to the construction of the second embodiment, a groove 70 is formed in the facing surface 55 of the lower yoke 54*b* and a tooth part 72 and a tooth part 74 that act as magnetic poles are provided at both ends of the groove 70.

A groove 76 is also formed in the outer circumferential surface 36*b* of the slider 36 at a position facing the facing surface 55 of the lower yoke 54*b*.

A tooth part 78 is provided on the other end-side of the groove. The tooth part 78 is positioned facing the tooth part 72 of the facing surface 55 of the lower yoke 54*b* and functions as a magnetic pole.

By increasing the number of tooth parts that act as magnetic poles in this way compared to the second embodiment, an even higher permeance is achieved than in the second embodiment, so that even higher propulsion can be realized.

It should be noted that the formation positions of the grooves and the tooth parts are not limited to the respective embodiments described above, and the formation positions and numbers can be changed within ranges that satisfy the state disclosed in the patent claims.

In the embodiments described above, the respective grooves and tooth parts have been illustrated as having rectangular cross-sectional forms. However, the cross-sectional forms of the grooves and tooth parts are not limited to this, and may be trapezoidal. By making the forms trapezoidal, the magnitude of the propulsion can be made different to when rectangular forms are used.

WORKING EXAMPLE

Figure 4:
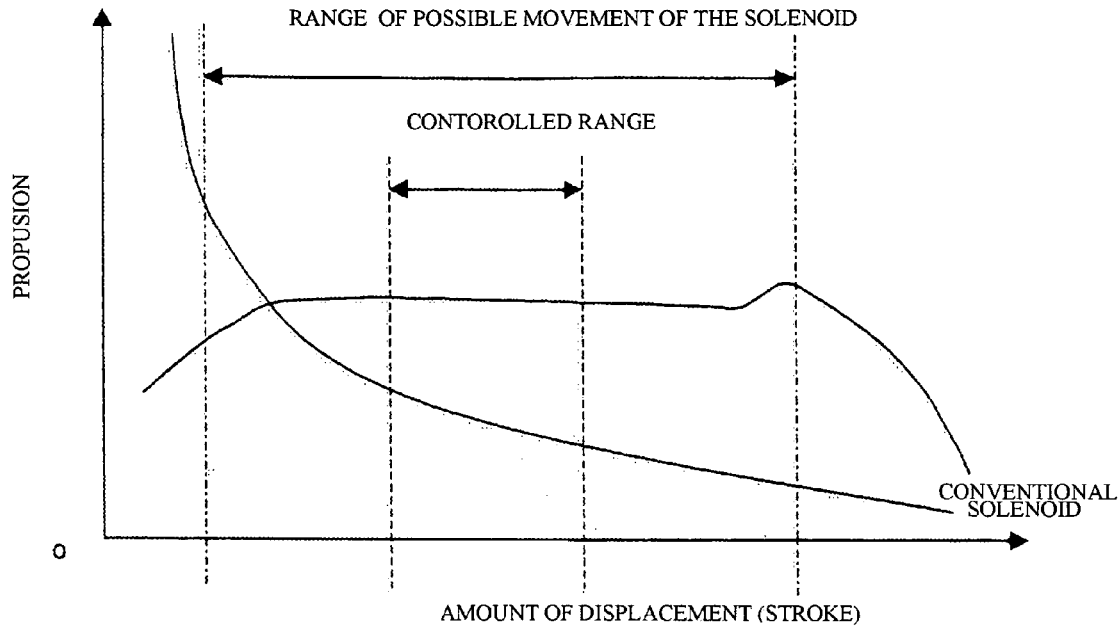
FIG. 4 is a graph showing the propulsion-displacement characteristics of a solenoid according to the second embodiment.
Figure 7:
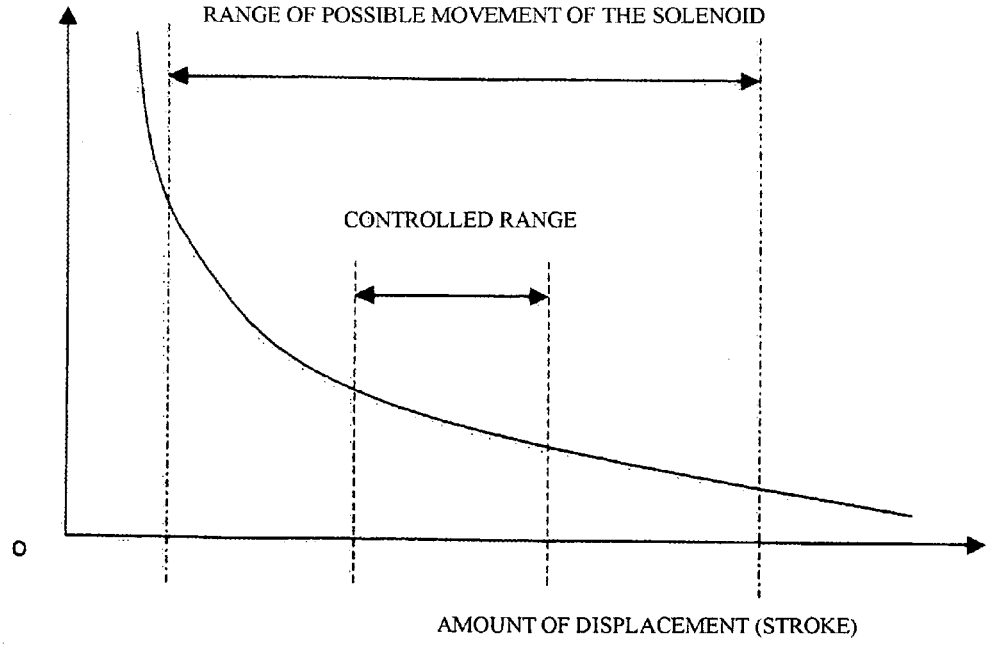
FIG. 7 is a graph showing the propulsion-displacement characteristics of a conventional solenoid.
Figure 5:
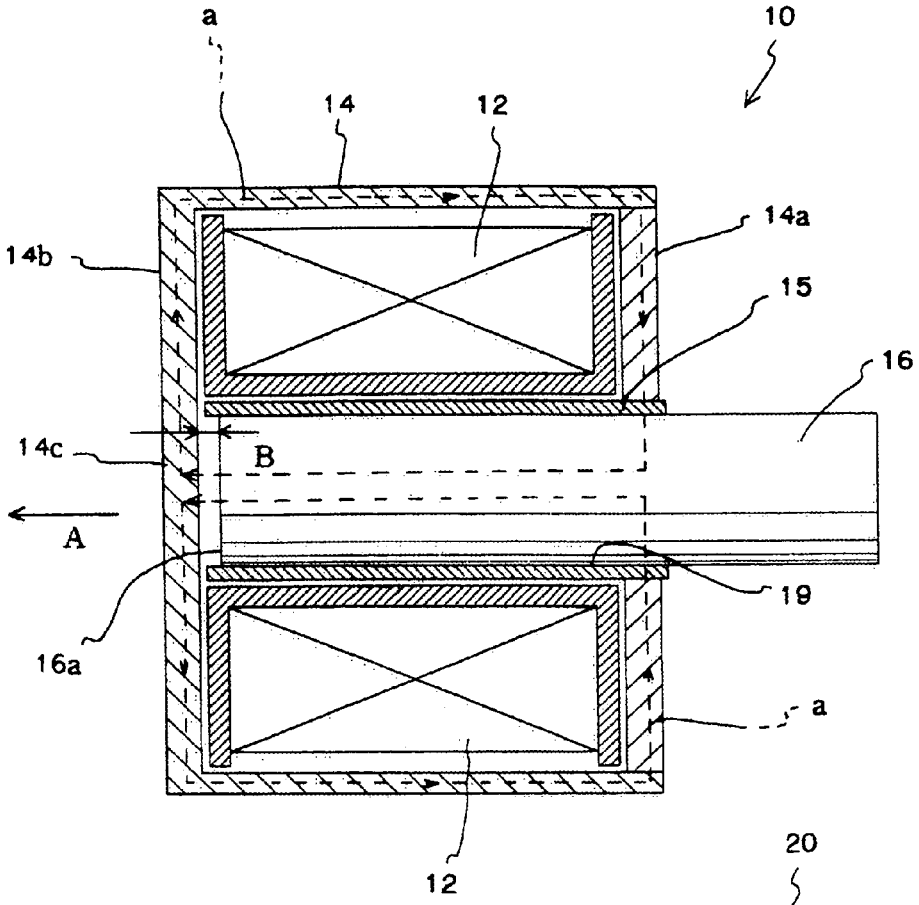
FIG. 5 is a cross-sectional view showing a conventional solenoid when viewed from a side surface.
Figure 6:
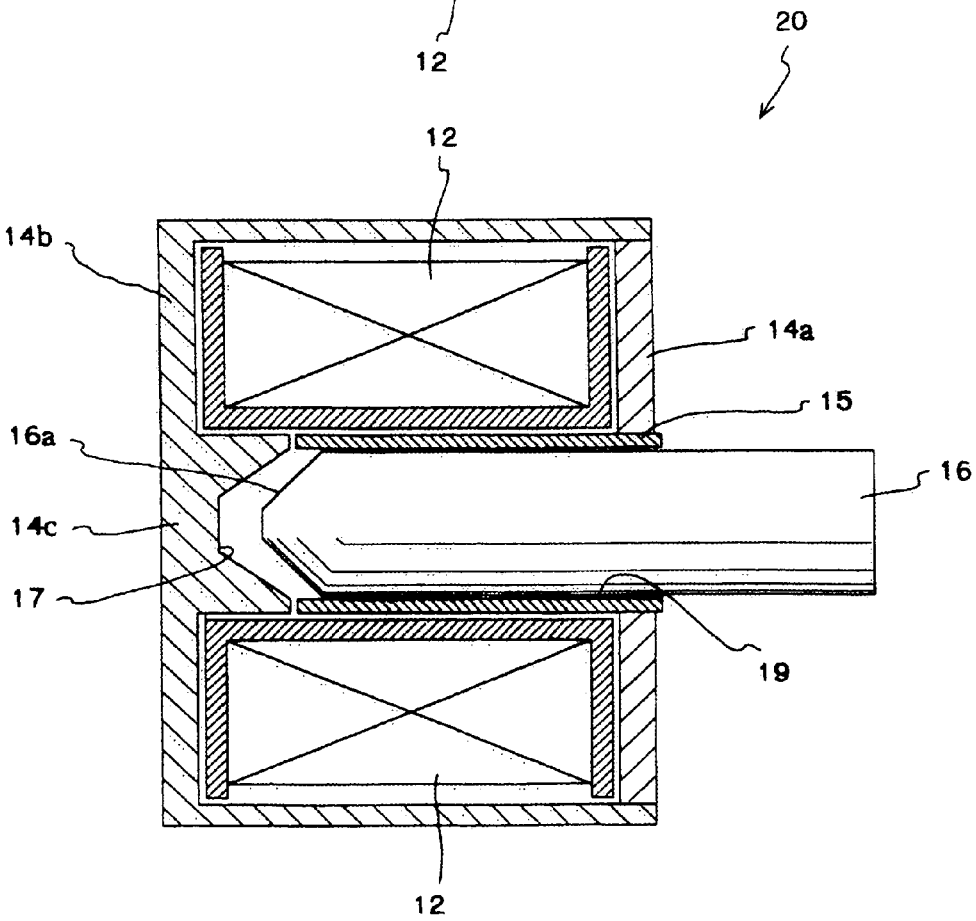
FIG. 6 is a cross-sectional view showing a different conventional solenoid when viewed from a side surface.

FIG. 4 shows the relationship between the stroke (amount of displacement) of the slider of the solenoid of the second embodiment described above and the generated propulsion. It should be noted that in the present graph, the propulsion-displacement characteristics of the conventional solenoid shown in FIG. 7 have also been shown for comparison purposes.

As shown in FIG. 4, by using the solenoid of the present invention, the propulsion characteristics in the controlled range determined by the amount of current flowing through the excitation coil 32 can be made substantially flat, and on average compared to the conventional solenoid, at least double the propulsion can be obtained. For this reason, a solenoid with extremely good controllability can be provided.

Various aspects of the present invention have been described above by way of favorable embodiments, but it should be obvious that the present invention is not limited to these embodiments and can be subjected to various modifications without departing from the spirit of the present invention.

EFFECT OF THE INVENTION

In the solenoid of the present invention, the body size can be miniaturized compared to the conventional art, the region where the propulsion is stabilized can be widened, and the controllability can be improved. In addition, higher propulsion can be obtained than before.

The invention claimed is:

1. A solenoid comprising:

an excitation coil;

a slider disposed in a central part of the excitation coil; and a yoke including a first yoke part that covers one end surface of the excitation coil and has a facing surface that faces an outer circumferential surface of the slider, a second yoke part that covers another end surface of the excitation coil and has a facing surface that faces the outer circumferential surface of the slider, and a linking part that links the first yoke and the second yoke and covers an outer circumferential part of the coil, the yoke forming a closed magnetic path together with the slider, wherein a bearing is fitted in both end sections of the first yoke part and the second yoke part including the facing surfaces, is disposed on an outer circumference of the slider, and guides the slider in a movable state, the bearing being made of a nonmagnetic body, n (where n is a positive integer of 0 or higher) grooves, which are provided so as to be concave around an inner circumference, and n+1 tooth parts, which are adjacent to the grooves and function as magnetic poles, are provided in the facing surface of the first yoke part, m (where m is a positive integer of 0 or higher) grooves, which are provided so as to be concave around an inner circumference and m+1 tooth parts, which are adjacent to the grooves and function as magnetic poles, are provided in the facing surface of the second yoke part, n+1 grooves, which are provided so as to be concave around an outer circumference, and n+1 tooth parts, which are adjacent to the grooves and function as magnetic poles, are provided in a surface of the slider that faces the first yoke part, and m grooves, which are provided so as to be concave around an outer circumference, and m tooth parts, which are adjacent to the grooves and function as magnetic poles, are provided in a surface of the slider that faces the second yoke part.

2. A solenoid according to claim 1, wherein the facing surfaces formed on the first yoke part and the second yoke part have a same internal diameter.

3. A solenoid according to claim 1, wherein the grooves and the tooth parts are formed so as to be rectangular or trapezoidal in cross-section.

4. A solenoid according to claim 2, wherein the grooves and the tooth parts are formed so as to be rectangular or trapezoidal in cross-section.

5. A solenoid according to claim 1, wherein a part, which is an upper end edge part of the groove provided in the slider and is located on a far side with respect to the bearing in an axial direction, is formed at a position that does not contact the bearing in a range where the slider moves.

6. A solenoid according to claim 2, wherein a part, which is an upper end edge part of the groove provided in the slider and is located on a far side with respect to the bearing in an axial direction, is formed at a position that does not contact the bearing in a range i where the slider moves.

7. A solenoid according to claim 3, wherein a part, which is an upper end edge part of the groove provided in the slider and is located on a far side with respect to the bearing in an axial direction, is formed at a position that does not contact the bearing in a range where the slider moves.

8. A solenoid according to claim 4, wherein a part, which is an upper end edge part of the groove provided in the slider and is located on a far side with respect to the bearing in an axial direction, is formed at a position that does not contact the bearing in a range where the slider moves.

9. A solenoid according to claim 2, wherein a recess is formed in the bearing so that a part, which is an upper end edge part of the groove provided in the slider and is located on a far side with respect to the bearing in an axial direction, does not contact the bearing in a range where the slider moves.

10. A solenoid according to claim 3, wherein a recess is formed in the bearing so that a part, which is an upper end edge part of the groove provided in the slider and is located on a far side with respect to the bearing in an axial direction, does not contact the bearing in a range where the slider moves.

11. A solenoid according to claim 4, wherein a recess is formed in the bearing so that a part, which is an upper end edge part of the groove provided in the slider and is located on a far side with respect to the bearing in an axial direction, does not contact the bearing in a range where the slider moves.

12. A solenoid according to claim 5, wherein a recess is formed in the bearing so that a part, which is an upper end edge part of the groove provided in the slider and is located on a far side with respect to the bearing in an axial direction, does not contact the bearing in a range where the slider moves.

13. A solenoid according to claim 6, wherein a recess is formed in the bearing so that a part, which is an upper end edge part of the groove provided in the slider and is located on a far side with respect to the bearing in an axial direction, does not contact the bearing in a range where the slider moves.

14. A solenoid according to claim 7, wherein a recess is formed in the bearing so that a part, which is an upper end edge part of the groove provided in the slider and is located on a far side with respect to the bearing in an axial direction, does not contact the bearing in a range where the slider moves.

15. A solenoid according to claim 8, wherein a recess is formed in the bearing so that a part, which is an upper end edge part of the groove provided in the slider and is located on a far side with respect to the bearing in an axial direction, does not contact the bearing in a range where the slider moves.

16. A solenoid according to claim 1, comprising:

an excitation coil;

a slider disposed in a central part of the excitation coil; and a yoke including a first yoke part that covers one end surface of the excitation coil and has a facing surface that faces an outer circumferential surface of the slider, a second yoke part that covers another end surface of the excitation coil and has a facing surface that faces the outer circumferential surface of the slider, and a linking part that links the first yoke and the second yoke and covers an outer circumferential part of the coil, the yoke forming a closed magnetic path together with the slider, wherein a bearing is sandwiched between the first yoke part and the second yoke part, is disposed on an outer circumference of the slider, and guides the slider in a movable state, the bearing being made of a nonmagnetic body, n (where n is a positive integer of 0 or higher) grooves, which are provided so as to be concave around an inner circumference, and n+1 tooth parts, which are adjacent to the grooves and function as magnetic poles, are provided in the facing surface of the first yoke part, m (where m is a positive integer of 0 or higher) grooves, which are provided so as to be concave around an inner circumference and m+1 tooth parts, which are adjacent to the grooves and function as magnetic poles, are provided in the facing surface of the second yoke, part, n+1 grooves, which are provided so as to be concave around an outer circumference, and n+1 tooth parts, which are adjacent to the grooves and function as magnetic poles, are provided in a surface of the slider that faces the first yoke part, and m grooves, which are provided so as to be concave around an outer circumference, m tooth parts, which are adjacent to the grooves and function as magnetic poles, are provided in a surface of the slider that faces the second yoke part, and wherein a recess is formed in the bearing so that a part, which is an upper end edge part of the groove provided in the slider and is located on a far side with respect to the bearing in an axial direction, does not contact the bearing in a range where the slider moves.

* * * * *